US006554390B2

(12) United States Patent
Arquilevich et al.

(10) Patent No.: US 6,554,390 B2
(45) Date of Patent: Apr. 29, 2003

(54) TEST PATTERN IMPLEMENTATION FOR INK-JET PRINTHEAD ALIGNMENT

(75) Inventors: Dan Arquilevich, Portland, OR (US); John A Underwood, Vancouver, WA (US); Braulio Soto, LaCenter, WA (US); Charles Woodruff, Brush Prairie, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 96 days.

(21) Appl. No.: 10/052,986

(22) Filed: Nov. 9, 2001

(65) Prior Publication Data

US 2002/0060709 A1 May 23, 2002

Related U.S. Application Data

(63) Continuation of application No. 09/263,962, filed on Mar. 5, 1999, now Pat. No. 6,347,856.

(51) Int. Cl.[7] ..... B41J 2/01
(52) U.S. Cl. ..... 347/19
(58) Field of Search ..... 347/19, 37; 358/406, 358/504; 400/709, 709.2

(56) References Cited

U.S. PATENT DOCUMENTS 5,250,956 A 10/1993 Haselby et al.
5,262,797 A 11/1993 Boeller et al.
5,289,208 A 2/1994 Haselby
5,297,017 A 3/1994 Haselby et al.
5,448,269 A 9/1995 Beauchamp et al.
5,451,990 A 9/1995 Sorenson et al.
5,600,350 A 2/1997 Cobbs et al.
5,644,344 A 7/1997 Haselby
5,796,414 A 8/1998 Sievert et al.
6,076,915 A 6/2000 Gast et al.
6,347,856 B1 * 2/2002 Arquilevich et al. ..... 347/19

FOREIGN PATENT DOCUMENTS

EP 0 622 238 11/1994

OTHER PUBLICATIONS

Press, Flannery, Teukolsky & Vetterling, "Numerical Recipes in C," Cambridge University Press, 1998, pp 293–296 & 305–307.

European Patent Office Search Report dated Apr. 23, 2002.

* cited by examiner

*Primary Examiner*—Craig Hallacher

(57) ABSTRACT

A method and means for automatic alignment of ink-jet printheads includes fitting measuring constructs to actual print data acquired form a print made using a given, predetermined, test pattern data set. Specific test patterns for use in automated alignment of ink-jet printheads are suited to providing a variety of printhead alignment information in a compact format. The test pattern data set incorporates techniques for avoiding carriage-induced dynamic errors during automated alignment of ink-jet printheads.

17 Claims, 9 Drawing Sheets

TEST PATTERN IMPLEMENTATION FOR INK-JET PRINTHEAD ALIGNMENT

CROSS REFERENCE TO RELATED APPLICATION(S)

This is a continuation of application Ser. No. 09/263,962 filed on Mar. 5, 1999 now U.S. Pat. No. 6,347,856, which is hereby incorporated by reference herein.

The present application is related to U.S. patent application Ser. No. 09/263,594, filed on the same date herewith, by the same inventors for an AUTOMATED INK-JET PRINTHEAD ALIGNMENT SYSTEM.

BACKGROUND OF THE INVENTION

1. Field of the Invention

The present invention relates generally to ink-jet printing and, more specifically to ink-jet pen alignment using test pattern analysis in a hard copy apparatus' self-test mode.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* see e.g., Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988).

An ink-jet pen includes a printhead which consists of a number of columns of ink nozzles. The nozzles are employed by printhead drop generating devices (generally thermal, piezoelectric, or wave propagation types) to fire ink droplets that are used to create a printed dots on an adjacently positioned print media as the pen is scanned across the media (for convenience of description, all print media is generically referred to as "paper" hereinafter). Generally, the pen scanning axis is referred to as the x-axis, the print media transport axis is referred to as the y-axis, and the ink drop firing direction from pen to paper is referred to as the z-axis. Within the columns of nozzles, groups of nozzles, called primitives are used to form nozzle arrays grouped by ink color, e.g., four primitives within a column for cyan, yellow, magenta, or black ink ("CYMK"). A given nozzle of the printhead is used to address a given vertical column position on the paper, referred to as a picture element, or "pixel," where each nozzle-fired drop may be only a few picoliters ($10^{-12}$ liter) in volume and the resultant ink dot only 1/600th-inch. Horizontal positions on the paper are addressed by repeatedly firing a given nozzle as the pen is rapidly scanned across the adjacent paper. Thus, a single sweep scan of the pen can print a swath of dots generally equivalent to the nozzle column height. Dot matrix manipulation is used to form alphanumeric characters, graphical images, and photographic reproductions from the ink drops. The print media is stepped in the y-axis to permit a series of scans, the printed swaths combining to form text or images.

In general, ink-jet hard copy apparatus are provided with two to four pens; either a set of three single color pens, or a single pen with three colorant reservoirs and at least three primitives, and a black ink pen. It is also known to print composite black using color ink. Static pen, and hence printhead nozzle alignment, is a function of the mechanical tolerances of the scanning carriage mounts for the individual pens. Moreover, ink-jet writing systems with reciprocating carriages typically have inherent dot placement errors associated with the dynamics of carriage motion. Such errors are usually associated with vibrations and therefore are cyclical in nature. If printing with a constant carriage velocity, these errors will manifest themselves on the paper at regular spatial pitches across the width of the page. Thus, among other factors, the pitch of the error will be a function of carriage velocity.

One method for determining and correcting nozzle-firing algorithms for pen alignment error parameters is where a hard copy apparatus prints a test pattern and uses the test pattern to determine the pen alignment error parameters. [Note that nozzle firing manipulation via computerized program routines, "algorithms," is a complex art in and of itself. While knowledge in that field is helpful, it is not essential to an understanding of the present invention which relates to printing error parameter derivations subsequently used by such nozzle firing algorithms.] Many such systems require the end user to inspect a variety of patterns visually and to select the pattern, and hence the hard copy apparatus settings, which are most appealing to that individual.

In U.S. Pat. No. 5,250,956, Haselby et al. use a test pattern for print cartridge bidirectional alignment in the carriage scanning axis; in U.S. Pat. No. 5,297,017, Haselby uses a test pattern for print cartridge alignment in the paper feed axis.

In U.S. Pat. No. 5,262,797, Boeller et al. disclose a standard pen plotter related method of monitoring and controlling quality of pen markings on plotting media in which an actual line plot is optically sensed across a selected point to make a comparison with a test line.

In U.S. Pat. No. 5,289,208, Haselby discloses an automatic print cartridge alignment sensor system.

In U.S. Pat. No. 5,448,269, Beauchamp et al. use a test pattern for multiple ink-jet cartridge alignment for bidirectional printing.

In U.S. Pat. No. 5,451,990, Sorenson et al. use specified test patterns as a reference for aligning multiple ink-jet cartridges.

In U.S. Pat. No. 5,600,350, Cobbs et al. teach multiple ink-jet print cartridge alignment by scanning a reference pattern and sampling the same with reference to a position encoder.

[Each patent listed above is assigned to the common assignee of the present invention. It is also known to use test patterns for testing and clearing of nozzles, testing ink quality, and for color correction; those functions are beyond the scope of the present invention and require no further explanation for an understanding of the present invention.]

Generally, large format ink-jet plotters use the strategy of using one block of nozzles from one column on one printhead as a reference. All other nozzles on every printhead are then aligned relative to this reference block.

There remains a need in the state-of-the-art for more accurate methodologies for aligning ink-jet printheads. There remains a need for automatic alignment of ink-jet printheads, that is, without the need for reliance on the user's visual acuity. There remains a need for techniques for avoiding carriage-induced dynamic errors during automated alignment of ink-jet printheads. There remains a need for test patterns for use in automated alignment of ink-jet printheads which are suited to providing a variety of printhead alignment information in a compact format.

SUMMARY OF THE INVENTION

In its basic aspects, the present invention provides an ink-jet test pattern for determining printhead alignment error correction values for an ink-jet hard copy apparatus. The pattern includes: on a single sheet of A-size print media, optically readable, individually spaced test pattern objects arranged to form a plurality of regions on said print media including a first region for acquiring reflectance value data indicative of x-axis error correction values, a second region for acquiring reflectance value data indicative of y-axis error correction values, a third region for acquiring reflectance value data indicative of error correction values in column-to-column spacing nozzle sets firing a same color ink from different nozzle columns of an individual printhead, a fourth region for acquiring reflectance value data indicative of primitive-by-primitive error correction values, and a fifth region for acquiring reflectance value data indicative of bidirectional, variable speed printing x-axis error correction values.

In another basic aspect, the present invention provides a method for aligning ink-jet printheads in a hard copy apparatus having a scanning carriage with a plurality of ink-jet pens mounted therein, each of said pens having a printhead, each of said printheads having a plurality of ink drop firing nozzles, and a printhead ink-jet nozzle-firing algorithm. The method includes the steps of: printing a test pattern on a single sheet of A-size print media, said test pattern including repetitious pairs of colored test objects; optically measuring actual offsets between the objects of each pair wherein offsets are indicative of respective printhead alignment aspects, including x-axis, y-axis, and z-axis alignments; calculating at least one printhead alignment error correction factor from said actual offsets; and providing a printhead alignment error correction factor to said nozzle-firing algorithm.

In yet another basic aspect, the present invention provides a computer memory for calculating factors for aligning ink-jet printheads in a hard copy apparatus having a scanning carriage with a plurality of ink-jet pens mounted therein, each of said pens having a printhead, each of said printheads having a plurality of ink drop firing nozzles, and a printhead ink-jet nozzle-firing algorithm. The memory includes: program routines printing a test pattern on a single sheet of A-size print media, said test pattern including repetitious pairs of colored test objects; program routines for storing optically measured actual offsets between the objects of each pair wherein offsets are indicative of respective printhead alignment aspects, including x-axis, y-axis, and z-axis, alignments; and program routines for calculating at least one printhead alignment error correction factor from said actual offsets.

It is an advantage of the present invention that it provides a unified method for measuring various systematic ink-jet printhead misalignment characteristics and parameters.

It is an advantage of the present invention that it provides an alignment correction factor having a greater resolution than previous methodologies.

It is another advantage of the present invention that an offset value correction as small as one-eighth of a printed dot diameter can be achieved.

It is another advantage of the present invention that it provides a computerized process which calculates alignment error values with minimal computational requirements.

It is a further advantage of the present invention that it provides a computerized, automated alignment error correction, requiring no visual perception assessment and comparison reassessment by the end-user of a variety of test patterns.

It is a further advantage of the present invention that it can be automatically implement upon a printhead change or user implemented, e.g., when changing print media.

It is an advantage of the present invention that it provides a test pattern plot that is quickly printed and analyzed using only one sheet of A-size paper.

It is an advantage of the present invention that it provides a test pattern plot which minimizes the need to print with one column of reference nozzles only.

It is an advantage of the present invention that it provides a test pattern plot wherein the printhead alignment process is less sensitive to defects in one particular reference block of nozzles.

It is another advantage of the present invention that it provides a test pattern which provides extensive data used to compensate for harmonic frequency carriage motion induced printing errors.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
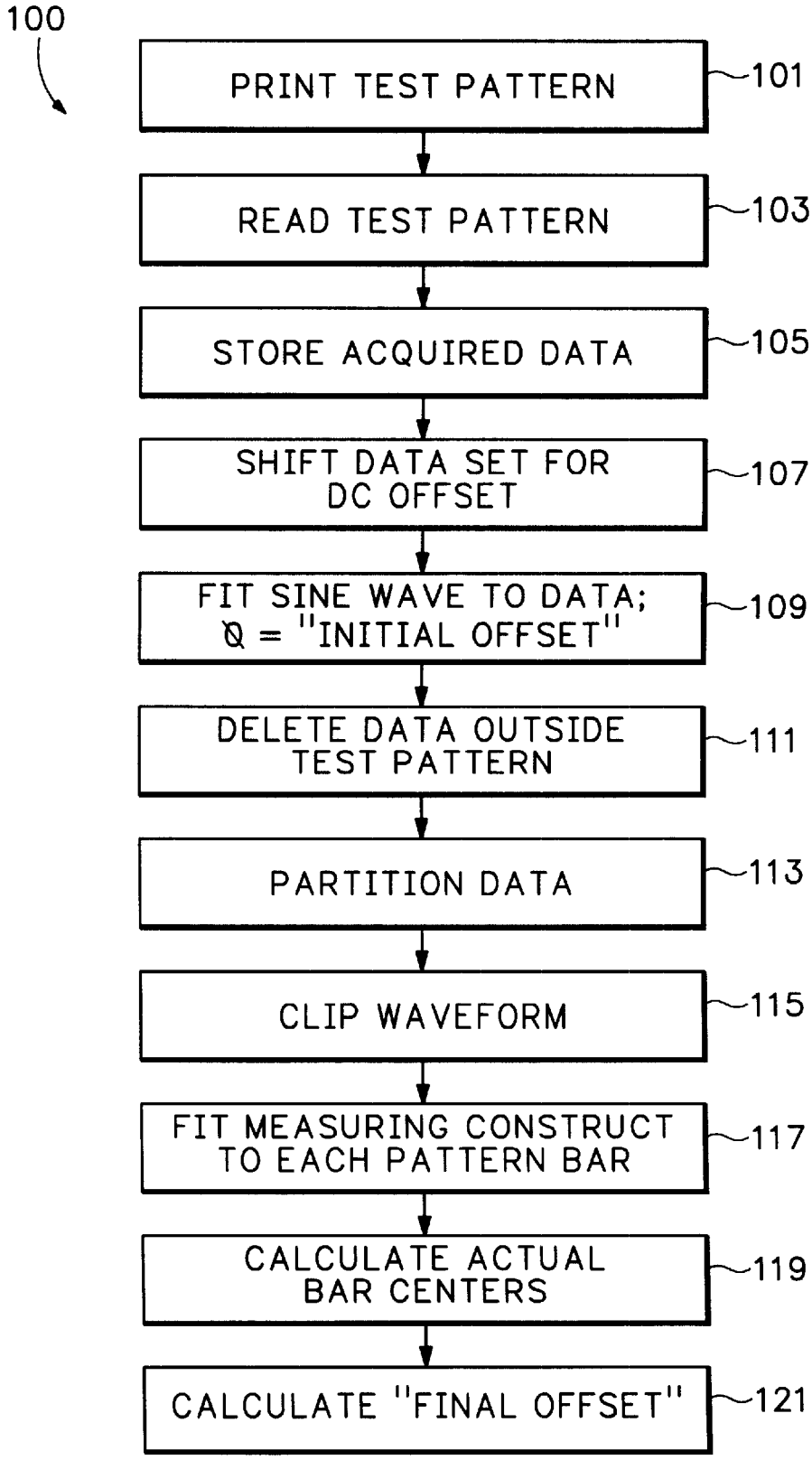
FIG. 1 is a flow chart of a method in accordance with the present invention for determining ink-jet printhead alignment offset values using test pattern data.

FIG. 1 represents a method 100 for determining printhead alignment offsets in accordance with the present invention. It is well known in the art that different print media—plain paper, special coated ink-jet paper, photographic quality paper, and the like—will react differently to the same ink. Using the pens and appurtenant printheads to be aligned, a test pattern is printed, step 101, on the particular print medium that the end user intends to use currently. It is prudent to activate a test mode, as detailed hereinafter, for pen alignment whenever pens are changed. Specific test patterns will be discussed hereinafter; referring briefly to FIG. 7, it can be seen that a preferred embodiment test pattern 701 comprises generally a variety of bar patterns (while other more complex patterns may be employed within the scope of the invention, bar patterns will be used as an example). The nominal spacing and width of printed bars in a given test pattern employed by the hard copy apparatus' test mode operation is known, the details being stored in a computer memory.

Returning to FIG. 1, the test pattern is read, acquiring data for bar spacing and bar width, step 103. The acquired data is stored, step 105, in a computer memory. In the preferred embodiment, the acquired data is obtained optically such that the data are representative of the amplitude of reflected light from the test pattern bars and spaces; sampling is made spatially every 1/600th-inch (see e.g., Haselby '956, Haselby '017, Beauchamp '269, Sorenson '990, and Cobbs '350, supra, incorporated herein by reference; a preferred optical sensor is also disclosed in co-pending U.S. patent application Ser. No. 08/885,486 by Walker, assigned to the common assignee of the present invention).

Figure 2:
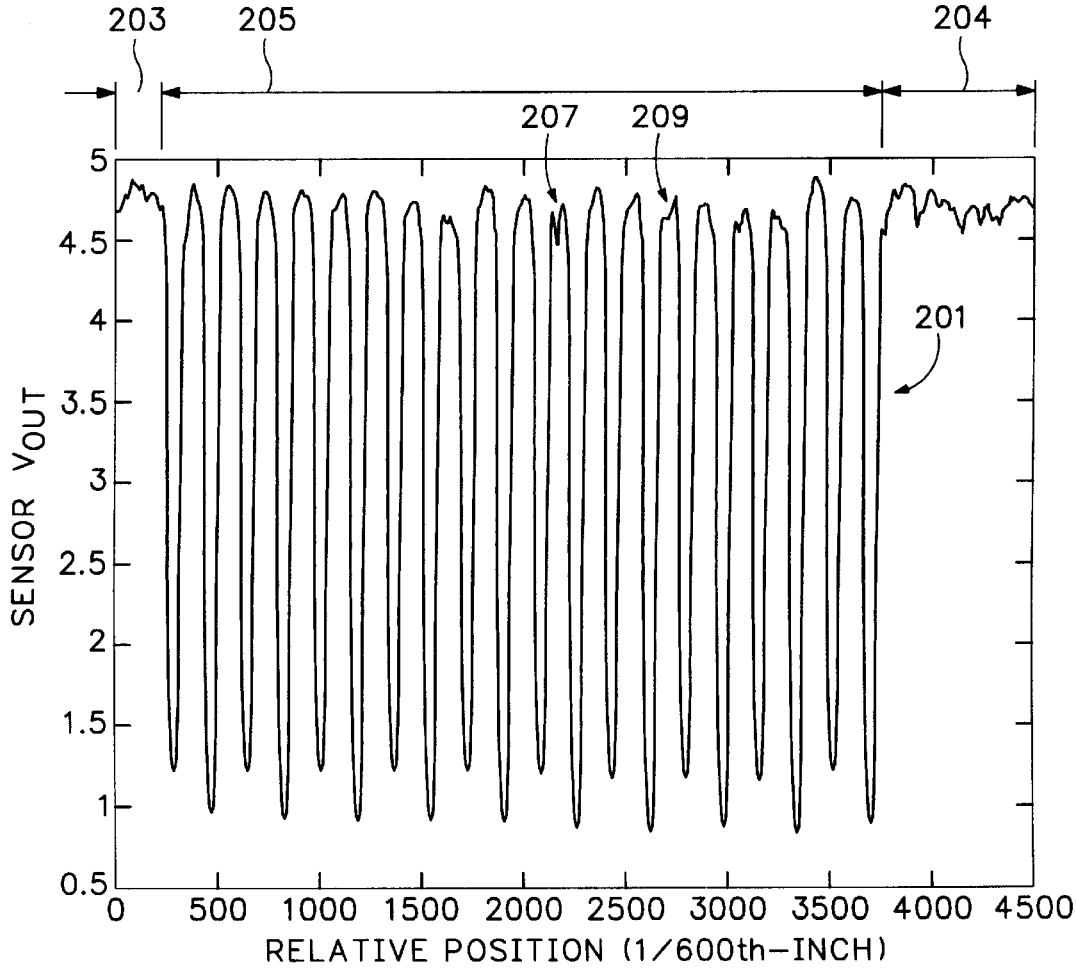
FIG. 2 is a waveform depicting exemplary data acquisition in accordance with the method shown in FIG. 1.

The acquired data from an optical scan across the page width will be in an analog form depicted by FIG. 2 (the actual waveform will naturally be a function of the resolution and sensitivity of the specific optical sensor employed). The analog reflectance data is processed via any known manner analog-to-digital conversion and digital signal processing techniques. Thus, the waveform 201 high data points of the sensor $V_{out}$ represent white spaces (high reflectivity); waveform 201 low data points represent color saturated regions of test pattern bars alternatingly printed using separate nozzle columns or primitives for which alignment compensation is to be determined. The exemplary waveform of FIG. 2 therefore represents a row of twenty printed bar and space patterns. That is, if the printed bars alternate color, e.g., cyan and magenta, or same color using different primitives for a primitive-to-primitive offset test, the reflectivity will alternatingly vary in intensity. Furthermore, if all nozzles for a particular color ink are fired in a specific scan swath, intensity may still vary from bar-to-bar based upon the paper-ink reaction, e.g., causing a cockle which will affect reflected light readings. A goal of the present invention is to use the waveform to determine a true center, versus the given test pattern nominal center, of each bar; a comparison will then determine a related and precise printhead alignment offset.

Figure 3:
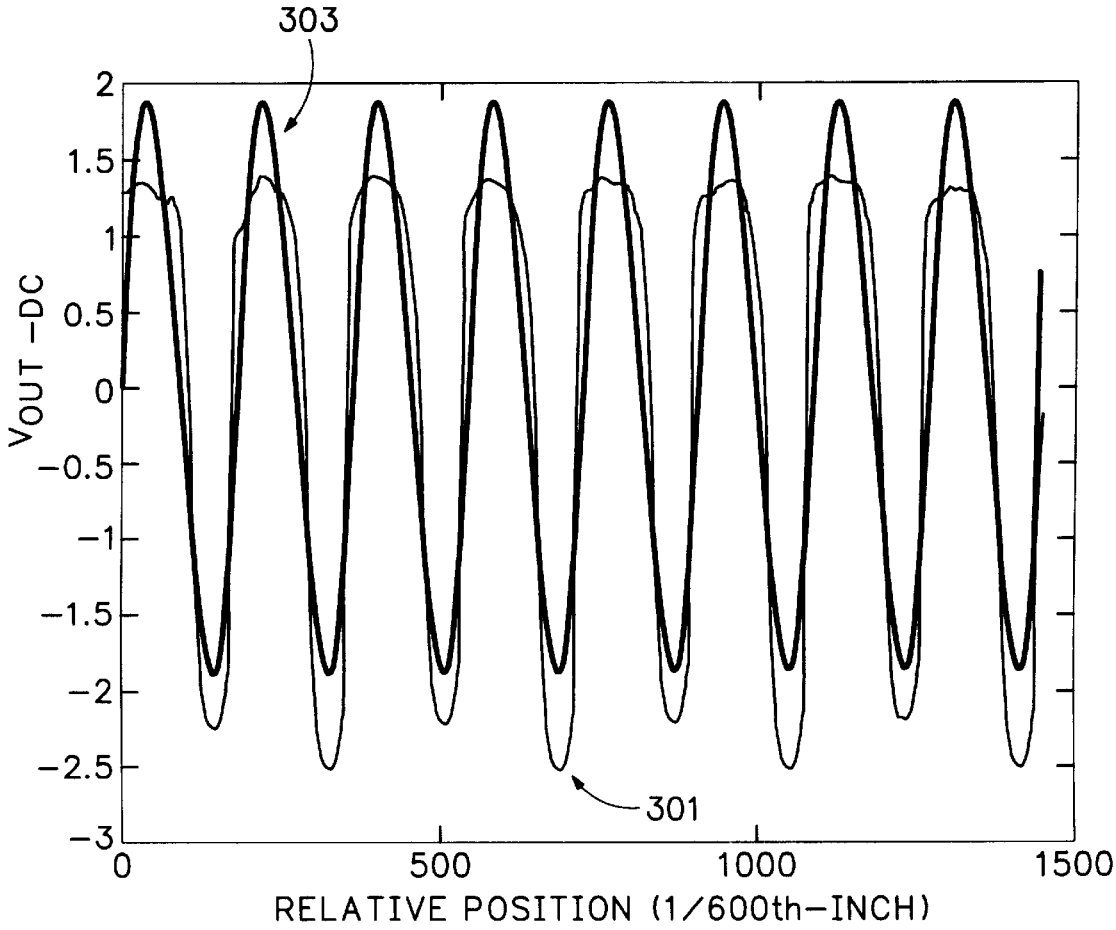
FIG. 3 is a waveform depicting acquired data sampling for determining an "initial offset" value in accordance with the method shown in FIG. 1.

A first data correction is made by eliminating any DC bias in the data, step 107. Approximately an eight-cycle sample of data points is selected as shown in FIG. 3 (as is known in the art, pulses off of the scanning pen carriage encoder providing the relative position of the sample points—actual implementation data sampling will be a function of encoder resolution) to ensure an appropriate average and the DC-offset subtracted. Specific implementations may use a different number of samplings depending on a specific statistical analysis employment related to the particular printhead operational design characteristics, processor memory, and computational budget requirements. The shifted data is shown in FIG. 3 as waveform 301. Referring again also to FIG. 1, a sine wave 303 is fitted to the shifted data sample 301 using a known manner digital signal processing "Golden Rule" search, step 109 (see e.g., Press, Flannery, Teukolsky & Vetterling, *Numerical Recipes in C, The Art of Scientific Computing*, copr. Cambridge University Press 1998, at pp. 293–296). The phase of this fitted sine wave represents an "initial offset" within the sample window, viz. within this eight-cycles. In other words, a sine wave having a known frequency matching the nominal frequency expected of the known test pattern data frequency and printhead operation parameters is phase shifted to match the actual data. The phase shift relative position then becomes the "initial offset," that is, where the test pattern bars begin on the plot relative to the expected position, e.g. an initial offset of ¼-dot width.

Acquired data also includes data which is outside the bar patterns, generally in the paper margins. In FIG. 2, this is represented by end regions 203, 204 of the waveform 201. The data for these regions, e.g. 80–300 data points, is deleted, step 111, from the acquired data set 105 by subtracting the initial offset; region 205 then is the retained acquired data. The retained acquired data is partitioned, step 113, into N-cycles, where N is the number of pattern objects, viz. a bar and white space, with, e.g., 180-digital data points forming a single cycle of the waveform 201.

Alternatively, from the known design of the given printed test pattern 101, a fairly accurate start of the data where partitioning, step 113, is to be performed can be estimated. From this starting point, a localized data search can determine the local maxima and minima of all the test pattern bars; those points can then be used to partition the data accordingly.

The original waveform 201 is then clipped, step 115, to remove any noise which will bias subsequent data processing steps used to determine "final offset" values, where final offset values or an averaged final offset value is then used by the nozzle-firing algorithm after the self test run is completed. Note that the peaks of the waveform 201 appear ragged such as at regions 207 and 209. This may be due to paper cockle, paper lay, and the like factors, showing up prominently in the white regions of the test pattern and to a lesser extent in the ink saturated bottom regions. The minimum clipping amount should be to at least the maximum deviation from the peak/trough values; in this exemplary embodiment, clipping the peaks to about $V_{out}$=4.7 and troughs at about $V_{out}$=1.3.

Next, step 117, a measuring construct is fitted to each clipped waveform 201' cycle in order to determine the actual center of each bar in the pattern.

Figure 4A:
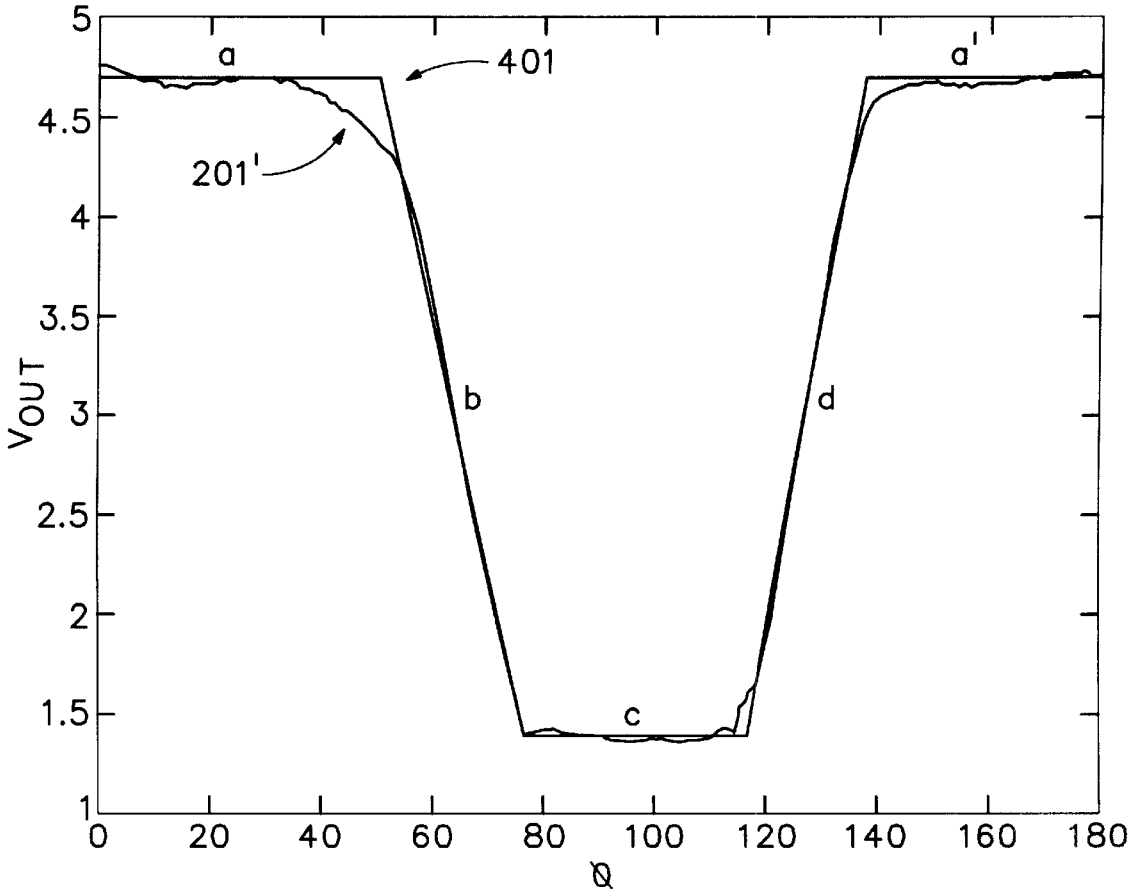
FIG. 4A is a waveform depicting a trapezoidal waveform fit to clipped acquired data in accordance with the method shown in FIG. 1.

In a first embodiment, using a known manner simplex non-linear minimization (see e.g., Press et al., supra, at pp. 305–307), a trapezoid waveform is fit to each wave form cycle, representing a test pattern bar and white space. FIG. 4A shows a fitted trapezoid waveform 401 and the clipped signal 201' of the retained acquired data for a single printed bar relative to adjacent white spaces, regions "a" and "e."

Thus, each trapezoid is a fit having the following parameters:

"a"=left top segment,

"b"=negative going slope,

"c"=middle bottom segment, and

"d"=positive going slope.

Figure 4B:
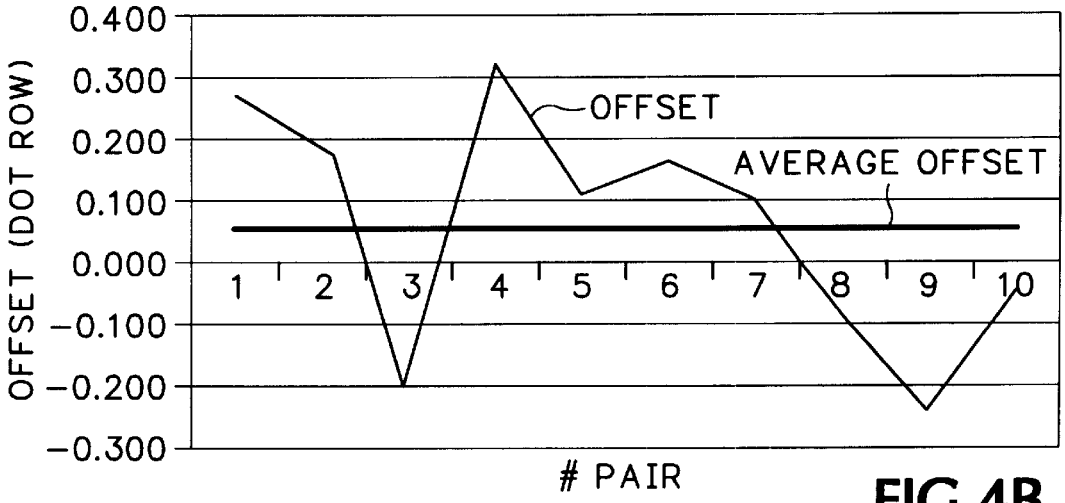
FIG. 4B is a graph showing exemplary relative position of trapezoid centers in accordance with the methodology shown in FIG. 4A.

Note that the slopes are a more accurate fit by being fitted to the clipped waveform 201' because data due to peak/trough ragged edges in the full waveform 201 have been deleted and thus do not bias the computation of the slopes "b" and "d." With the trapezoidal measuring construct, using the parameters "a–d," the center of region "c" is determined, step 119. For the twenty bar exemplary test pattern, FIG. 4B graphically depicts the relative position of trapezoid centers compared to an ideal where the center-to-center given test pattern distance should be ninety when one-hundred eighty data points are analyzed.

Figure 4C:
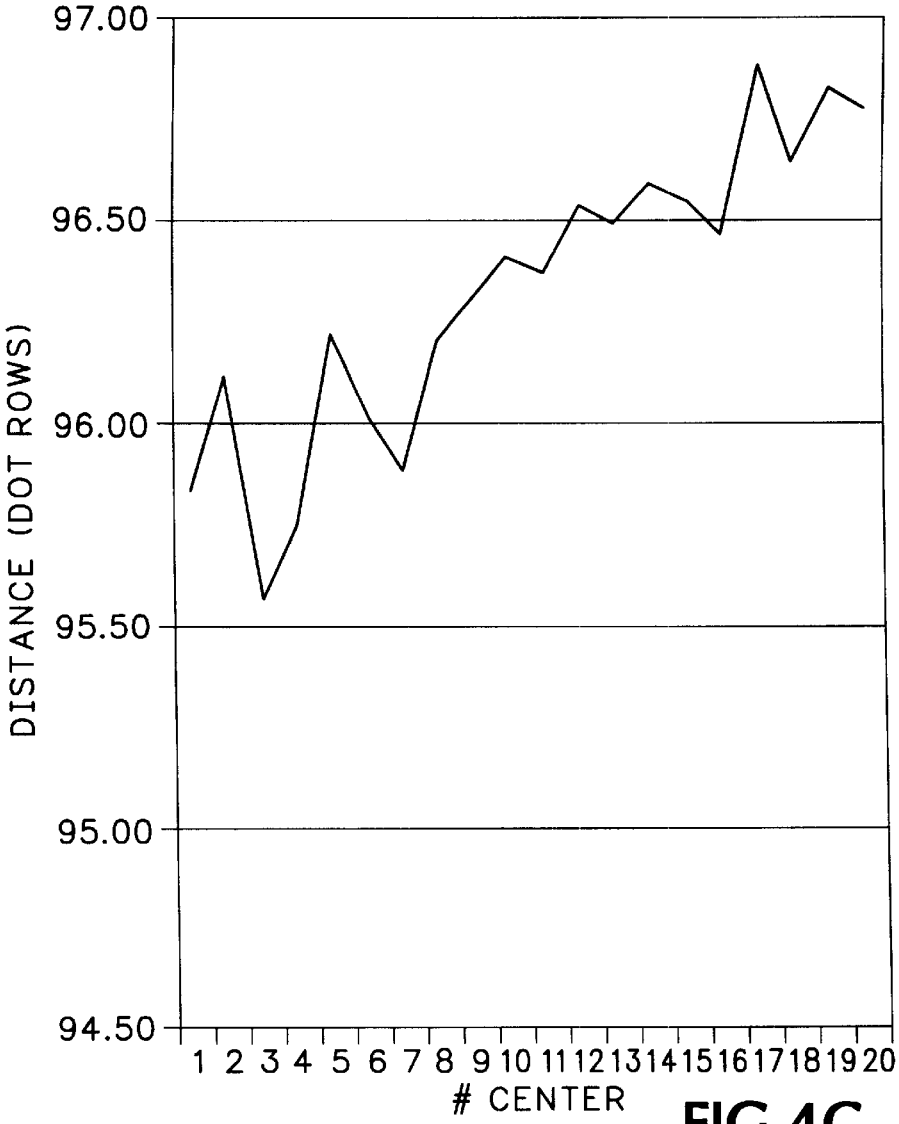
FIG. 4C is a graph showing exemplary offset between adjacent test pattern figures in accordance with the methodology shown in FIGS. 4A and 4B.

The final offset is calculated by subtracting the centers of each pair of adjacent bars. In the present exemplary data set there are twenty bars, or ten pairs, so the sum of the differences divided by ten will be returned as the final average offset value for that particular pattern of bars for use by the nozzle firing algorithm, step 121. FIG. 4C is a plot to the pair differences in the exemplary embodiment with the average represented by the dash-line.

In other words, if a row of bars is partitioned into adjacent pairs, bar A1+bar B1, bar A2+bar B2, bar A3+bar B3, et seq., then errors due to misalignment would be calculated as:

$$1^{st} \text{ pair offset} = (B1 - A1) - PS_d \quad \text{[Equation 1]}$$

$$2^{nd} \text{ pair offset} = (B2 - A2) - PS_d \quad \text{[Equation 2]}$$

$$\vdots \qquad \vdots$$

$$N^{th} \text{ pair offset} = (BN - AN) - PS_d, \quad \text{[Equation N]}$$

where $PS_d$ is the designed pattern spacing expected. The errors for all pairs of bars are averaged to arrive at the final average offset value:

$$\text{final average offset value} = \Sigma \text{pair offsets} \div N \quad \text{[Equation 3].}$$

Note that any single final offset of a pair could be used, but integrating toward an average using more data, namely from a full row of colored bar pairs, provides an average final offset value that will more accurately compensate for the cyclical errors. Since the errors are generally static, being related to the mechanical tolerances between the pens and the pen carriage, it can be assumed that the final offset is the same across a full scan width. The offset between adjacent bars will have a give standard deviation from the mean. Note also that with adequate memory and data processing capability, each bar pair offset data could be used individually by the nozzle-firing algorithm as a real time offset value during each relative position phase of a swath scan.

For bidirectional scanning the right-to-left offset will be the same absolute value with opposite delay imposed by the nozzle-firing algorithm.

Alternative calculations can be employed. For example, a determination of the location of the midpoint between successive alternate bars, A1-to-A2, is obtained from the acquired data. The location of the center point for the intervening bar, B1, is obtained and compared to the A1-to-A2 midpoint. Since the pitch of the bars is theoretically constant across the whole row, the difference between these two locations is the error in location for that intervening bar. Thus, the formula for the first error values would be:

$$\text{error value } 1^{st} \text{ pair} = (\text{midpoint } A1 \text{ and } A2) - \text{midpoint } B1 \quad \text{[Equation 4],}$$

et seq.

Again, the calculated error values are then averaged for the test pattern row or column of bar pairs. Note that this calculation is not dependent on an assumed design theoretical spacing and therefore immune to certain types of systematic errors, such as encoder scaling problems. For example, if the pitch on the carriage position encoder strip were flawed such that it scaled all distances up by ten-percent, all of the errors calculated with the $PS_d$ factors would reflect this error in spacing between bars in each pair being compared thereto. However, generally B-bars are substantially half way between A-bars of the pattern, therefore the second formula should be effective at determining true printhead misalignment.

It should be noted that the process of the present invention provides a methodology which can be used to solve a variety of alignment errors, namely primitive-to-primitive, column-to-column, pen-to-pen, and the like.

Figure 7:
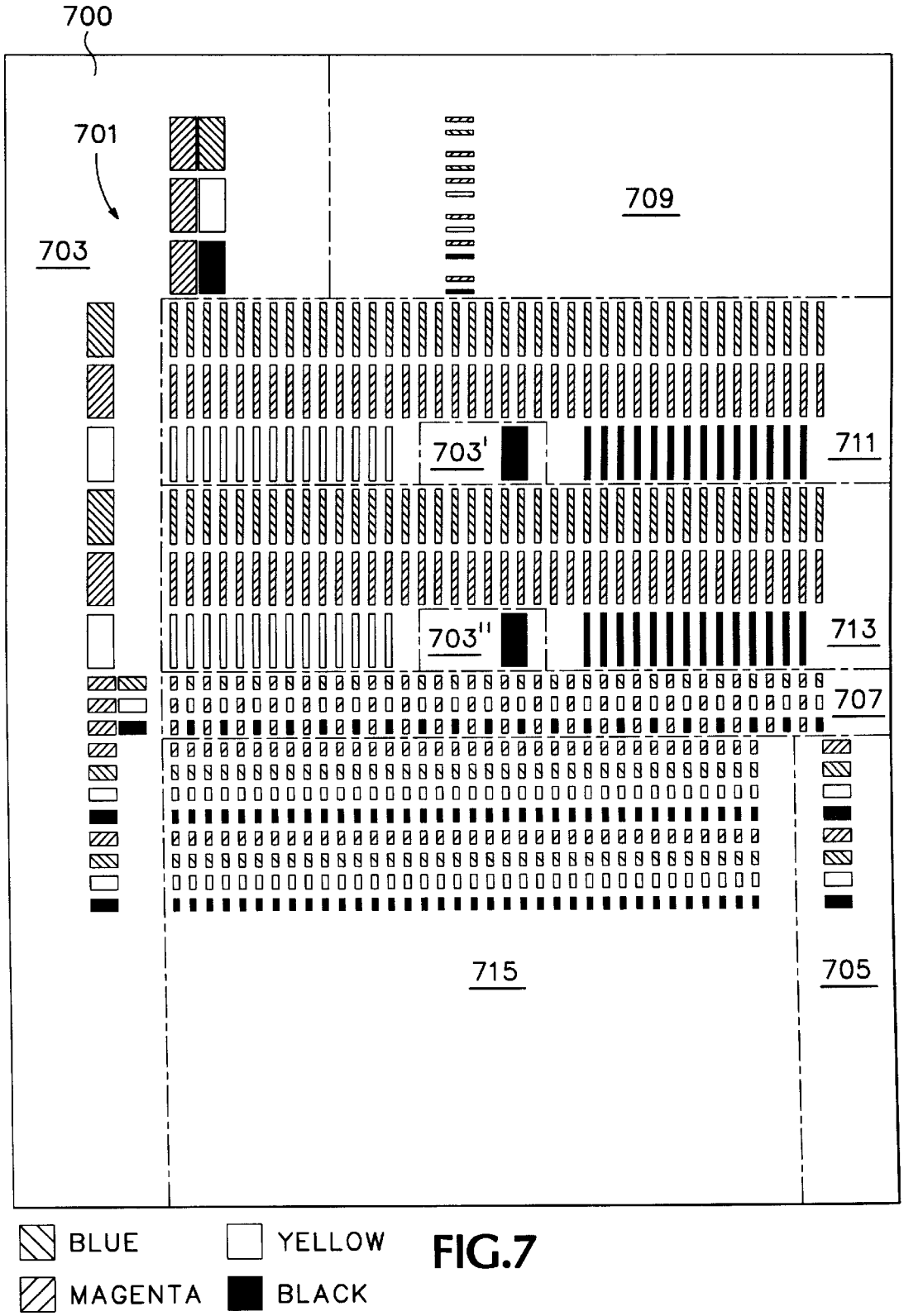
FIG. 7 is a test pattern in accordance with the present invention, useful in accordance with the method shown in FIG. 1.

FIG. 7 demonstrates a test pattern 701 in accordance with the present invention for an ink-jet printer which can be quickly printed with color and black inks and analyzed on one sheet of A-size paper 700; the actual plot is in CYMK inks, but for purpose of this patent application the color of each bar of the test pattern is depicted by using the appropriate letter for each ink. The layout of the plot of this test pattern allows each printhead to be aligned independently and for four printheads to be aligned to each other. Thus, this plot provides pen-to-pen horizontal and vertical alignments, printhead nozzle column-to-column alignment, scan axis directionality shape (shape of the dots on the page when fired from one supposedly straight column of nozzles) compensation alignment, rotation about the z-axis of either the die within the printhead or the printhead within the carriage (also referred to as "theta-z"), and bidirectional printing alignment.

Regions 703, 703', 703" and 705 are printed in order to fire all nozzles to clear any ink clogs, air bubbles, and the like, which cause nozzle firing problems as is well known in the art, and to bring thermal ink drop generators up to operating temperature. Regions 703, 703', 703" and 705 generally are not used in the compiling of acquired test pattern data (FIG. 1, step 103). Region 707 demonstrates a test pattern region where offset values as discussed herein with respect to FIG. 1 are determined which are particularly related to pen-to-pen alignment in the horizontal, x-axis, scanning, using magenta as the reference nozzle set, viz. magenta to cyan in the first row, magenta to yellow in the second row, and magenta to black in the third row. This reference region 707 exercises the magenta printhead only approximately five-percent more than the other regions of the plot, generally all four pens are exercised equally, making the alignment process less sensitive to defects in one particular reference block of nozzles.

Region 709 provides a series of horizontal bars, vertically aligned. Printing and analyzing region 709 in accordance with the methodology as shown in FIG. 1 will provide an alignment offset in the paper-path direction, or y-axis.

Region 711 provides full column nozzle firing from pen to determine offsets in column-to-column spacing nozzle sets firing the same ink but from different nozzle columns. Therefore, a row of color bars is printed in each of the colors, Cyan, Magenta, Yellow, and black, again each designated by capital letters within the bars of FIG. 7. Every other bar of a row is printed with a different column, firing the full column for that color ink. Accuracy will be dependent on the exact scanning device implementation. Thus, the number of bars in a row can be tuned, or optimized by experimentation, to provide sufficient signal strength results and appropriate statistical averaging.

Note that during scanning of the printed rows, the scanned bars also can be vertically partitioned to relate offset values column-to-column for different nozzle sets within a primitive. The calculated related offsets are then transferred to the nozzle firing algorithm accordingly.

Region 713 of the plot is similar to region 711, however the bars are printed to determine primitive-by-primitive offset values. A column of dots forming a color bar printed from different primitives is intended to be identical to a bar printed by firing all nozzles. However, in manufacture, the nozzles in a column are not always perfectly aligned but are given a column alignment tolerance. During firing, individual nozzles may also have trajectory variations. In a pair of printed bars of the test plot region 713, one bar is printed as in region 711 by firing all nozzles in both columns and the other bar of region 713 is printed in sections, stepping the paper a quarter column per scan; in other words every other column requires "$N_p$" passes, where $N_p$=number of primitives in the printhead for that color ink. One primitive set is used to print every other bar during the $N_p$ passes, forming a full bar. The primitive set used to print the sectioned alternating bars thus becomes a reference position. The scanning and calculation of offset then forms a reference value for the offset between the primitive used as the reference and the other primitive sets.

Region 715 comprises a row of each color set and the pattern is repeated. Every other bar is printed in the opposite scanning direction to determine bidirectional printing offset values. A repetition is provided for each design scanning speed, or a pattern is printed at the slowest scanning speed and highest scanning speed and the offset values assumed to have a linear relationship if other scanning speeds are provided in the hard copy apparatus.

Note also that a partial test pattern print can be employed when a pen change involves any number less than all four printheads, e.g., changing only a cyan pen in a four pen system. Once a new printhead is installed and identification of the change recognized, the print and scan process can be automatically altered to only print and scan the sections of the test pattern which is relevant to the printhead that has been changed. In this example, the print and scan process time should be reduced to approximately one-quarter of the full test cycle.

To summarize, the automated alignment system of the present invention provides a printing of an alignment pattern which is scanned and analyzed to determine alignment correction factors. As shown in the test plot of FIG. 7, the alignment patterns typically consist of repetitious pairs of colored bars or blocks—or other geometric patterns that can be easily analyzed or which fits the particular need for specific data in a specific hard copy implementation—and the process measures and calculates the offsets between the bars of each pair with differences being related to different alignment aspects, e.g. vertical, y-axis, alignments, horizontal, x-axis, alignments, and perpendicular ink drop firing, z-axis, alignments. However, in a worst case scenario for carriage-induced dynamic errors, problems will arise if the spacing of the bars is equal to half the pitch of the dynamic error. In this scenario, the first bar of each pair lies on the "high" spot of the vibration-induced motion causing a drop placement error while the second bar lies 180-degrees out-of-phase on the "low" spot of the vibration-induced motion. When such is the case, the carriage-induced dynamic error is inadvertently built into the test pattern. Such "harmonic" or other "beat frequency" errors would be added on top of the signal for the true pen alignment parameter that is supposed to be measured. Hence the resulting alignment offset value calculated would be flawed. A number of techniques for altering a test pattern for avoiding inadvertent built-in test pattern error are shown in FIGS. 8A through 8E.

Figure 8A:
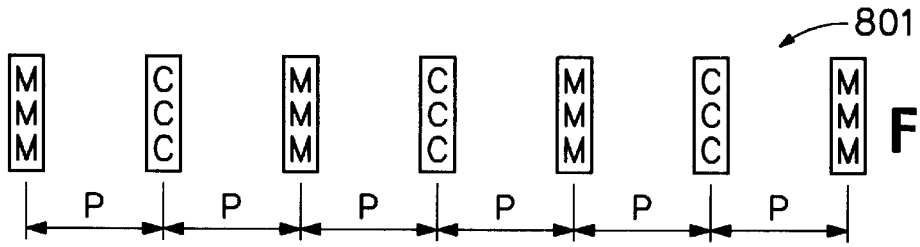
FIGS. 8A through 8E depict pattern variations for the test pattern in accordance with the present invention as shown in FIG. 7.

FIG. 8A demonstrates a test pattern for averaging offset measurements over a plurality of cycles. If the frequencies of the two inputs—the dynamic carriage-induced alignment error and the color block spacing—do not match but still create an error at some beat frequency, the offsets measured across several cycles of the beat frequency average out the error effects. The repeating pattern of FIG. 8A shows a pattern 801 of repeated cyclic alternating color blocks where the printed pitch, "P," is matched to the projected vibration frequency of the carriage actually measured or based upon mechanical design projections.

Figure 8B:
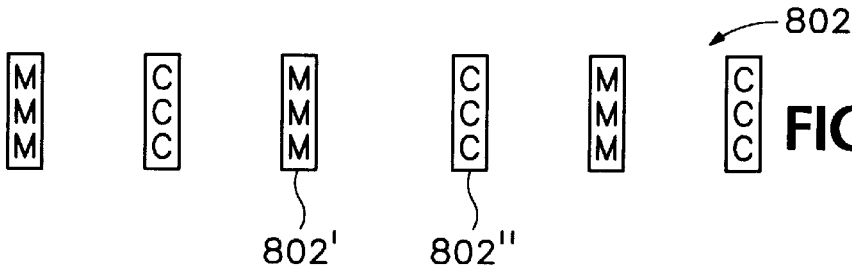

FIG. 8B demonstrates a test pattern 802 which will detect if block print pitch is in fact half that of a dynamic carriage-induced error. Skipping half a block print cycle, namely between blocks 802' and 802", in the middle of the row of the block pattern 802 will cause the blocks to reverse with respect to carriage row cycles. That is, the error offset value for one-half of the row will be the opposite of the error offset value for the other half and can be averaged out in the final offset value.

Figure 8C:
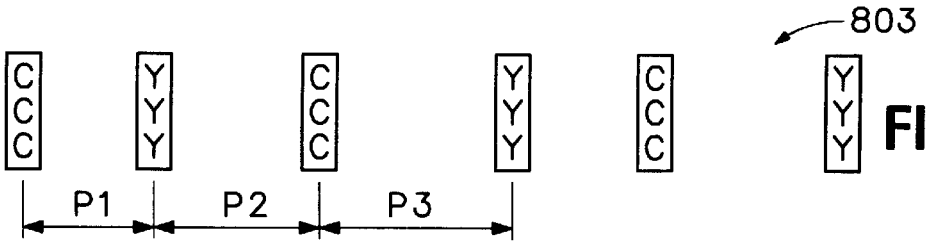

FIG. 8C depicts a test pattern 803 in which the block cycle spacing—P1, P2, P3—is varied along the row. When the gaps between each-pair of colored block are varied rather than constant, repeated measurement will take place at varying locations relative to the dynamic carriage effects.

Figure 8D:
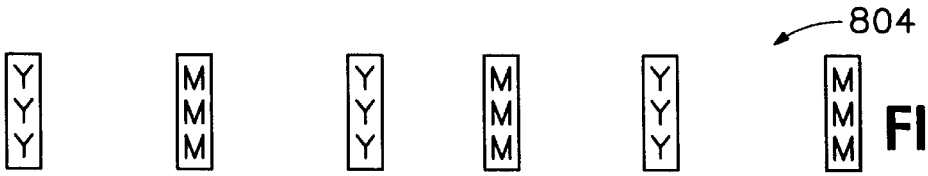

FIG. 8D depicts a test pattern 804 in which the block cycle spacing is set to avoid known dynamic carriage-induced errors. When the frequency of the dynamic carriage-induced at a particular print speed, or speeds, is well characterized, the spacing of the printed blocks is set for a different frequency.

Figure 8E:
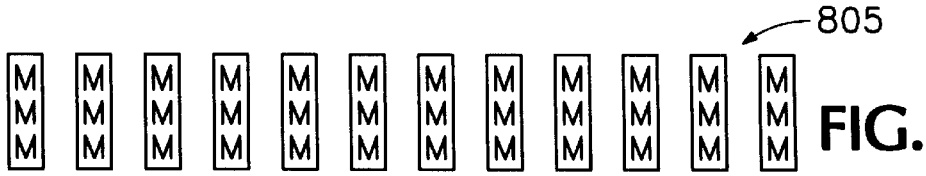

FIG. 8E demonstrates the use of a block pattern 805 as a reference row. A reference row of blocks is printed with all the same set of nozzles from the same printhead. The measured spacing between the two members of each block pair should be consistent, i.e. the frequency of the blocks is known by design. If the measured spacing deviates from the intended spacing, the error is due to a systematic problem such as dynamic carriage-induced vibration or paper-to-pen irregularities, e.g. cockle, non-flat positioning on the platen, and the like. The recorded errors in the reference row are subtracted from subsequent measurements of printhead alignment patterns to normalize the resultant calculations.

While FIG. 7 does not incorporate any of the FIG. 8A–8E techniques, it is intuitively obvious that one or more of such spacing irregularities can be incorporated in the specific regions of the page set.

Figure 5:
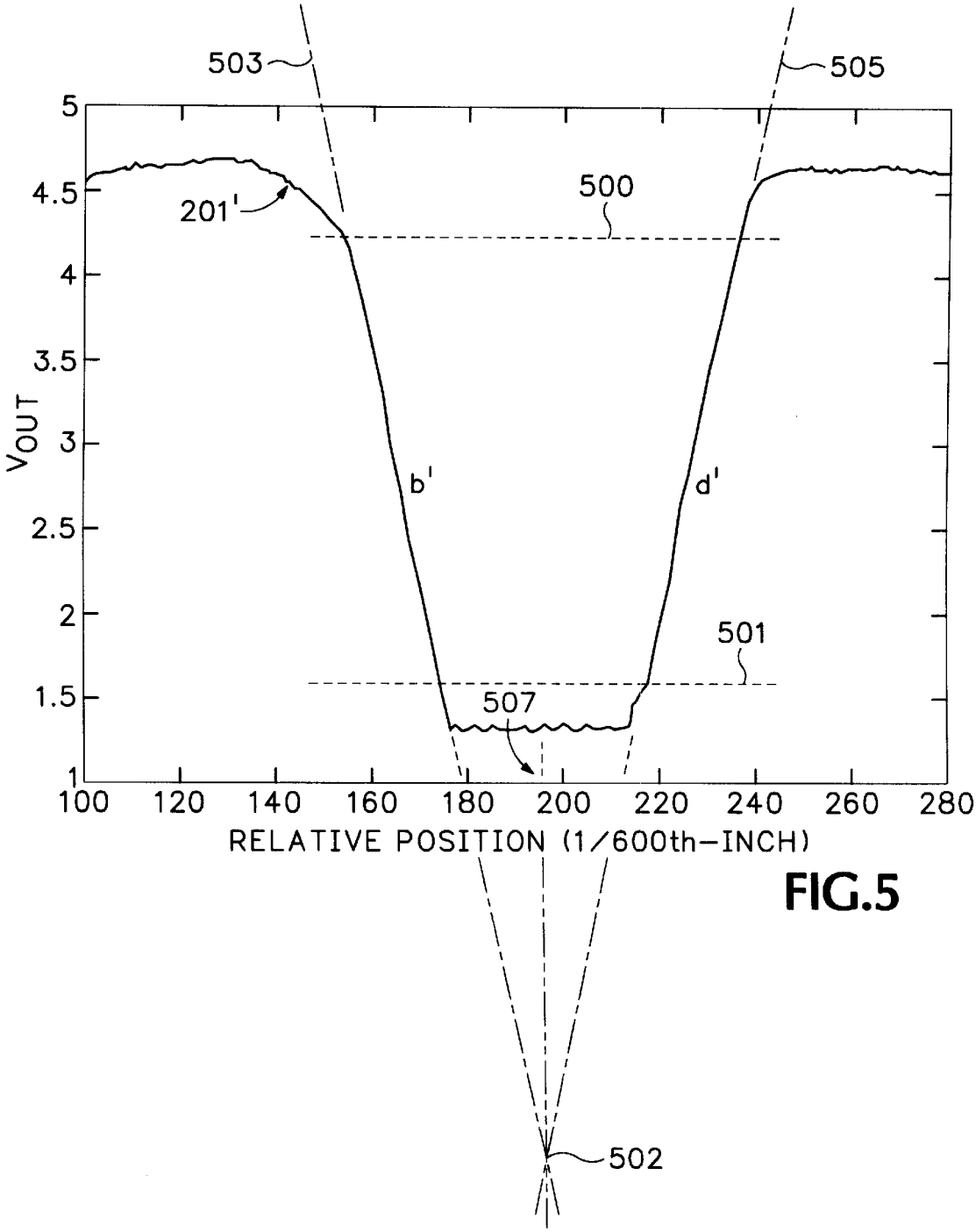
FIG. 5 is a waveform depicting an alternative embodiment waveform measurement construct fit to acquired data in accordance with the method shown in FIG. 1.

In a second embodiment, FIG. 5, of the method for determining offset values (FIG. 1, step 117), an alternate measuring construct is employed to determine the true center of each bar, step 119, and, hence, the final average offset value, step 121. The actual data waveform 201' is clipped, but to a greater extent than that used in the trapezoidal waveform fit demonstrated by FIG. 4. For the present exemplary, the actual data is clipped (dashed lines 500 and 501) at about $V_{out}$=4.25 and 1.75 to ensure the data is being looked at where the slopes b' and d' are substantially linear. Then to determine the center of a color bar, the intersection 502, least-squares linear fit lines 503, 505 to the data and projections of slope is used to determine the center 507.

Figure 6:
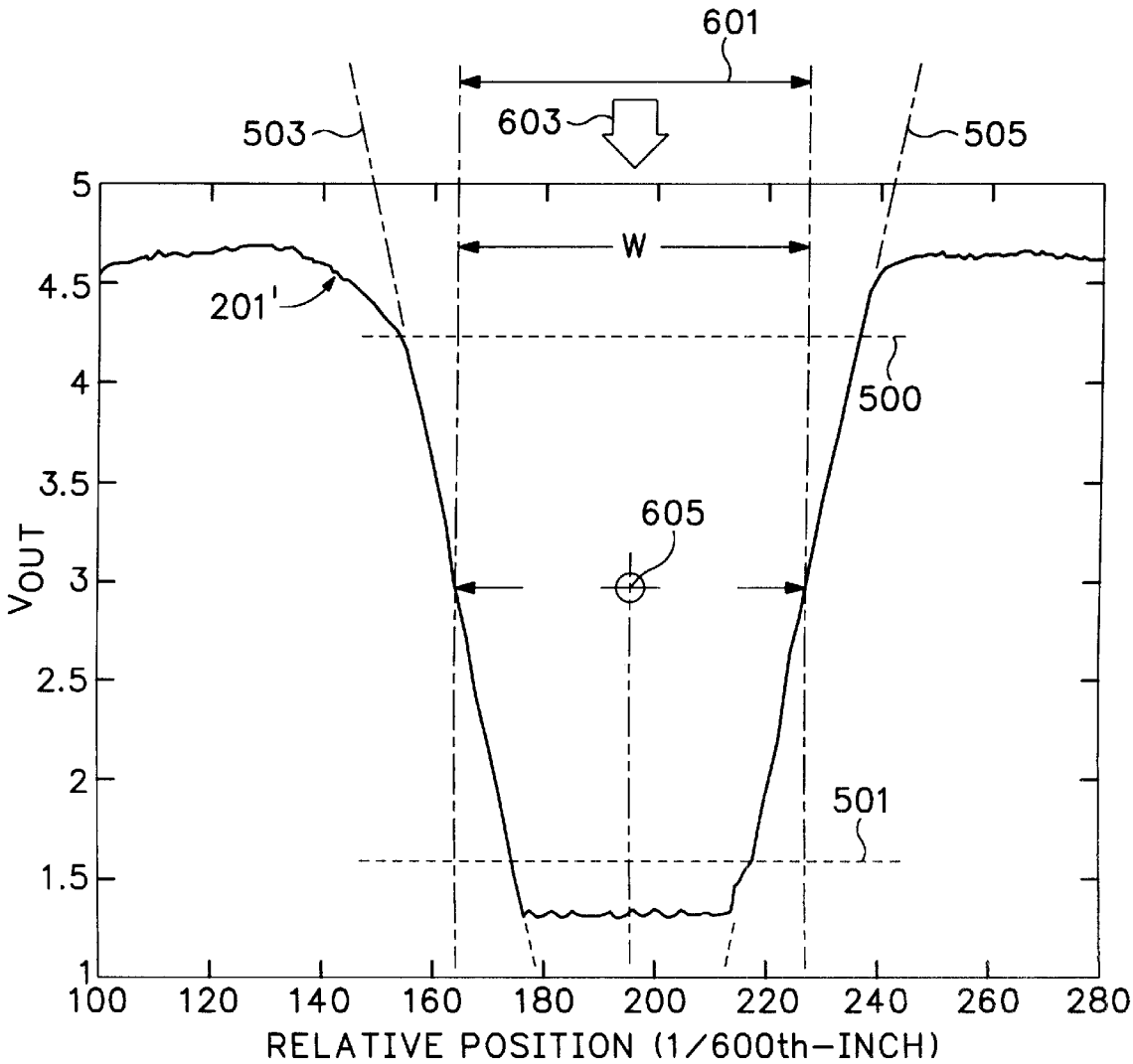
FIG. 6 is a waveform depicting another alternative embodiment waveform measurement construct fit to acquired data in accordance with the method shown in FIG. 1.

In a third embodiment, FIG. 6, another alternate measuring construct is employed to determine the true center of each bar and, hence, the final average offset value. From the given test pattern, the theoretically ideal bar widths and spacings are known. An ideal test bar measuring construct 601 is used, having a width, "W," from the design parameters. A least-squares linear fit lines 503, 505 to the data and projections of slope is again used with the clipped (dashed lines 500 and 501) actual data. The ideal test bar measuring construct 601 is "dropped" (arrow 603) to find the intersection, data match points, of each end of the construct with the fit lines 503, 505. The location of the midpoint 605 of the construct 601 at this match is then used to calculate the offset value for the bar in question.

The present invention provides an automatic, impartial, test pattern printing and read-back data analyzing to determine printhead alignment offset values that can then be employed by a nozzle-firing algorithm to correct for printhead alignment errors which would otherwise cause errors in printing a given dot matrix pattern. Using a single page test pattern which incorporates a variety of alignment data in all three printing axes provides a fast, economical mechanism for applying corrections to improve the print quality of subsequent print outs. The present invention may be implemented in hardware or software using known manner computer memory devices.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A method for aligning ink-jet pens in a hard copy apparatus having a scanning carriage with a plurality of said ink-jet pens mounted therein, each of said pens having a printhead, each of said printheads having a plurality of ink drop firing nozzles, said pens being controlled by a printhead ink-jet nozzle-firing algorithm, said method comprising:

printing a test pattern on a single sheet of print media, said test pattern including repetitious pairs of colored test objects wherein said pairs of colored test objects are respectively related to a plurality of error correction values for aligning said printheads such that in combination said values are defined for said algorithm;

optically measuring actual offsets between the objects of each pair wherein offsets are indicative of respective printhead alignment aspects, including x-axis, y-axis, and z-axis alignments;

calculating at least one printhead alignment error correction factor from said actual offsets; and providing a printhead alignment error correction factor to said nozzle-firing algorithm.

2. The method as set forth in claim 1, said printing further comprising:

printing a first region for acquiring reflectance value data indicative of x-axis error correction values, printing a second region for acquiring reflectance value data indicative of y-axis error correction values, printing a third region for acquiring reflectance value data indicative of error correction values in column-to-column spacing nozzle sets firing a same color ink from different nozzle columns of an individual printhead, printing a fourth region for acquiring reflectance value data indicative of primitive-by-primitive error correction values, and printing a fifth region for acquiring reflectance value data indicative of bidirectional, variable speed printing x-axis error correction values.

3. The method as set forth in claim 2, said printing a first region comprising:

printing repetitious pairs of colored objects having an irregular spacing.

4. The method as set forth in claim 3, said printing further comprising:

printing a pattern of repeated cyclic alternating color blocks having a printed pitch, "P," matched to a vibration frequency of the scanning carriage.

5. The method as set forth in claim 3, said printing repetitious pairs of colored objects having an irregular spacing further comprising:

printing a pattern having a spacing including skipping half a block print cycle.

6. The method as set forth in claim 3, said printing repetitious pairs of colored objects having an irregular spacing further comprising:

printing a pattern in which the block cycle spacing is randomly or pseudo-randomly varied along the row.

7. The method as set forth in claim 3, said printing repetitious pairs of colored objects having an irregular spacing further comprising:

printing a pattern in which object spacing is set to avoid specific predetermined dynamic carriage-induced errors.

8. The method as set forth in claim 2, said printing said first region further comprising:

printing a pattern as a reference row all with a same set of nozzles from one printhead with spacing between the two members of each pair of objects in said pattern having a predetermined frequency.

9. A computer memory for calculating factors for aligning ink-jet pens in a hard copy apparatus having a scanning carriage with a plurality of ink-jet pens mounted therein, each of said pens having a printhead, each of said printheads having a plurality of ink drop firing nozzles, and said apparatus including a printhead ink-jet nozzle-firing algorithm, comprising:

computer code for printing a test pattern on a single sheet of print media, said test pattern including repetitious pairs of colored test objects wherein said pairs of colored test objects are respectively related to a plurality of error correction values for aligning said printheads such that in combination said values are defined for said algorithm;

computer code for storing optically measured actual offsets between the objects of each pair wherein offsets are indicative of respective printhead alignment aspects, including x-axis, y-axis, and z-axis, alignments; and computer code for calculating at least one printhead alignment error correction factor from said actual offsets.

10. The computer memory set forth in claim 9, comprising:

computer code for printing a first region for acquiring reflectance value data indicative of x-axis error correction values, computer code for printing a second region for acquiring reflectance value data indicative of y-axis error correction values, computer code for printing a third region for acquiring reflectance value data indicative of error correction values in column-to-column spacing nozzle sets firing a same color ink from different nozzle columns of an individual printhead, computer code for printing a fourth region for acquiring reflectance value data indicative of primitive-by-primitive error correction values, and computer code for printing a fifth region for acquiring reflectance value data indicative of bidirectional, variable speed printing x-axis error correction values.

11. The computer memory as set forth in claim 10 further comprising:

said code for printing a first region comprising code for printing repetitious pairs of colored objects having an irregular spacing.

12. The computer memory as set forth in claim 11, said code for printing further comprising:

computer code for printing a pattern of repeated cyclic alternating color blocks having a printed pitch, "P," matched to a vibration frequency of the scanning carriage.

13. The computer memory as set forth in claim 11, the code for printing repetitious pairs of colored objects having an irregular spacing further comprising:

computer code for printing a pattern having a spacing including skipping half a block print cycle.

14. The computer memory as set forth in claim 11, the code for printing repetitious pairs of colored objects having an irregular spacing further comprising:

computer code for printing a pattern in which the block cycle spacing is randomly or pseudo-randomly varied along the row.

15. The computer memory as set forth in claim 11, the code for printing repetitious pairs of colored objects having an irregular spacing further comprising:

computer code for printing a pattern in which object spacing is set to avoid specific predetermined dynamic carriage-induced errors.

16. The computer memory as set forth in claim 10, said code for printing said first region further comprising:

computer code for printing a pattern as a reference row all with a same set of nozzles from one printhead with spacing between the two members of each pair of objects in said pattern having a predetermined frequency.

17. A method for correcting firing trajectories of a plurality of ink-jet pens mounted in a hard copy apparatus scanning carriage, each of said pens having a printhead, each of said printheads having a plurality of ink drop firing nozzles, wherein each printhead is controlled by an ink-jet nozzle-firing algorithm, said method comprising:

printing a test pattern on predetermined regions of a single sheet of A-size print media, said test pattern including repetitious pairs of colored test objects wherein said pairs of colored test objects are respectively related to a plurality of error correction values for aligning said printheads such that in combination said values are defined for said algorithm, including printing a first region for acquiring reflectance value data indicative of x-axis error correction values, printing a second region for acquiring reflectance value data indicative of y-axis error correction values, printing a third region for acquiring reflectance value data indicative of error correction values in column-to-column spacing nozzle sets firing a same color ink from different nozzle columns of an individual printhead, printing a fourth region for acquiring reflectance value data indicative of primitive-by-primitive error correction values, and printing a fifth region for acquiring reflectance value data indicative of bidirectional, variable speed printing x-axis error correction values;

optically measuring actual offsets between the objects of each pair wherein offsets are indicative of respective printhead alignment aspects;

calculating at least one printhead alignment error correction factor from said actual offsets; and providing said at least one printhead alignment error correction factor to said nozzle-firing algorithm.

* * * * *